United States Patent [19]

Austin

[11] 4,182,463

[45] Jan. 8, 1980

[54] REAR LOADING HOOK

[76] Inventor: Harold D. Austin, 1152 NW. 106 St., Miami, Fla. 33150

[21] Appl. No.: 926,804

[22] Filed: Jul. 21, 1978

[51] Int. Cl.[2] ..... B65H 3/58

[52] U.S. Cl. ..... 221/26

[58] Field of Search ..... 221/26, 30, 312; 248/218.2, 218.3, 220.3, 220.4, 221.1, 221.2; 225/27

[56] References Cited

FOREIGN PATENT DOCUMENTS 1139047 2/1957 France ..... 221/26

*Primary Examiner*—Stanley H. Tollberg

[57] ABSTRACT

A rear loading hook, especially for surgical, sterile blister packs, which hook has an upper run which extends outwardly from a hook mounting base and which upper run is reversely turned back upon itself to define a parallel generally horizontal lower run beneath it and wherein there is defined a distal bight between the upper and lower runs; and, additionally, a slicing blade is arranged and fixed in the bight with its cutting edge facing inwardly toward the hook base; the base is adapted for connection to a wall or vertical support; the hook is structured so that surgical items especially sterilized blister packaged cards with the hole in the card margin may be rear loaded on the lower run and moved forwardly for a first in, first out removal therefrom by slicing the front most card from the hook.

5 Claims, 4 Drawing Figures

REAR LOADING HOOK

FIELD OF THE INVENTION

This invention relates to hooks and, more particularly, to a rear loading hook which is especially adapted for surgical sterile packs to be supported thereon to be removed in a first in, first out manner.

BACKGROUND OF THE INVENTION

In the past there have been numerous types of wall mounted hooks which have a generally outwardly extending arm or run to support blister packed items on cards with a hole in the margin. This invention is of an improved hook of that type which is rear loading in the sense that the items are loaded on the hook from the rear and moved progressively forwardly to a front position to be removed by slicing the card margin to remove the card from the hook using a downward and outward jerking force drawing the card margin across the cutting edge of a blade which is situated at the distal or outer hook end, as shown in the drawings.

This hook is especially useful for storing dated surgical or sterile items of the type which are blister packaged on cards with a hole being provided in each of the cards adjacent one of the margins. In the past, when a supply of dated or sterilized material is placed on such hooks, if one is going to replenish the supply on the hook, it is often necessary to remove all of the items which remain on the hook to place the new or latest or replenished supply behind those which remain of the earlier mounted supply. In other words, the new items must be placed on the rear of the hook, instead of the front, so that each will be used in seriatum or in a first in first out manner.

This invention avoids that unloading step or problem because new items may simply be inserted on the rear loading and moved forward, progressively, as the supply on the hook is used. It will be appreciated by those in the art that in hospitals, for example, where large numbers of items, such as gloves, scissors, pins, bandages, etc. are blister-packed after being sterilized, this is an important time-saving advance in the crowded hook art.

OBJECTS OF THE INVENTION

For blister packaged items on cards having a hole adjacent one margin, it is an object of this invention to provide an improved hook which includes an upper run and a lower run with a cutting blade distally arranged and proximally facing between the runs, and wherein the lower run terminates adjacent, but spaced from, the inner end of the hook, so that the lower run is adapted to provide a run for rear loading of fresh cards and, thereafter, progressive forward, outward movement on the run until the cards progressively reach the forward end, when each may be removed in seriatum by slicing it against the cutting edge with a downward and outward tugging force for removal of the blister package. In this manner each of the cards is used in seriatum in the manner in which they have been positioned on the hook, and new cards may be mounted on the hook in back of or behind those earlier mounted cards, so that same may be used on a first in, first out basis, without the step of removing the older cards from a hook before the new cards can be mounted to it.

It is another object of this invention to provide a hook which is of the rear loading improved type which is simple and inexpensive to manufacture, which is a time-saver in use, and which is well adapted for the purposes which are set forth more fully hereinafter.

In accordance with these and other objects which will become apparent hereinafter, the instant invention will now be described with reference to the accompanying drawings, in which:

DESCRIPTION OF THE PREFERRED EMBODIMENT

Figure 1:
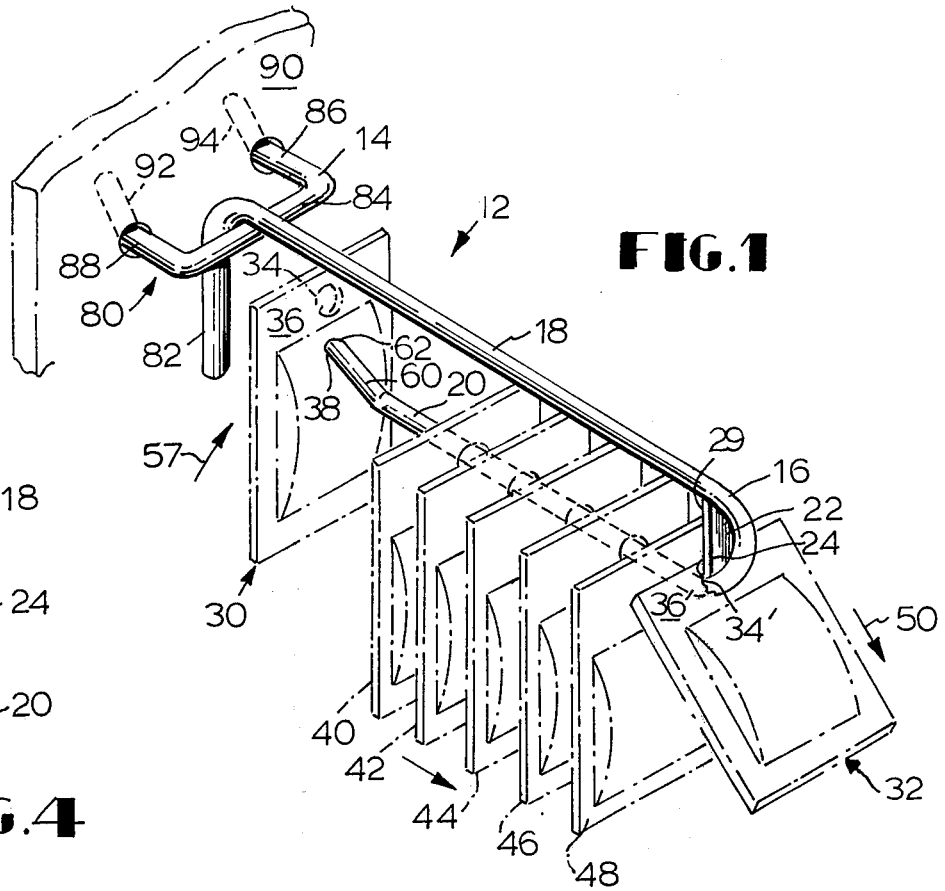
FIG. 1 is a perspective view illustrating the rear load hook of the instant invention in use and in connection with a mounting board.
Figure 4:
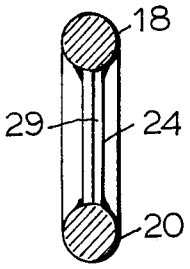
FIG. 4 is a view in cross section taken on the plane indicated by the line 4—4 of FIG. 2 and looking in the direction of the arrows.
Figure 3:
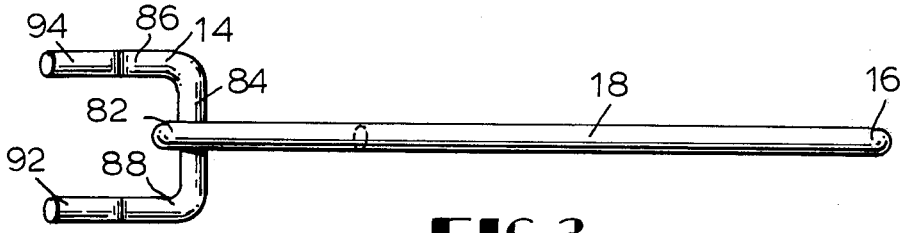
FIG. 3 is a top plan view of the hook shown in FIG. 3.
Figure 2:
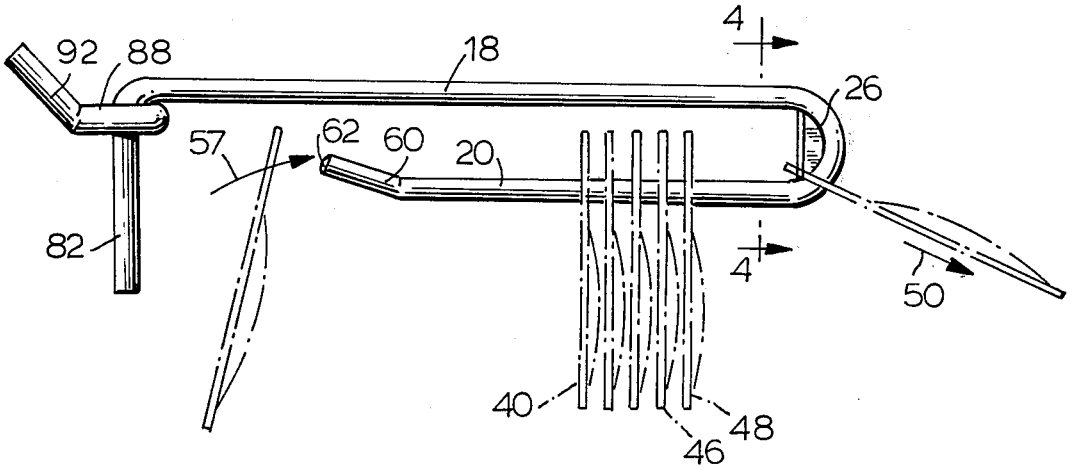
FIG. 2 is a side elevation view of the hook shown in FIG. 1.

Referring to the drawings wherein like reference characters designate like or corresponding parts throughout the several views and referring particularly to FIG. 1 there is shown a hook which is generally designated by the numeral 12 and which may be considered to have an inner end zone 14 and an outer end zone 16. Between the inner zone 14 and the outer zone 16 there is an upper run 18 and, below that, a generally parallel and horizontal run 20. At the zone of juncture of the upper and lower runs 18 and 20 there is a bight 22 defined at the outer end 16. Fixed within this bight there is a blade 24, which may be welded as at 26 and which includes a blade edge 29 which faces toward the inner end 14. It is thus seen that items such as that designated by the numerals 30 and 32, which are characterized by a hole 34 therethrough along the margin 36 may be loaded on the inner terminal end 38 and progressively moved forwardly as are the items 40, 42, 44, 46 and 48 until the same is at the forwardmost end as is the item 32. In this position, it may be yanked forwardly and downwardly in the direction of the arrow 50, slicing the margin 36' about the hole 34'. It is thus seen that dated items, such as hospital materials can be readily removed in seriatum, that is in the order in which they are placed on the hook. A person may keep track of these items and always have them in the order of first in, first out, which is important with items which have been sterilized, for example. Preferably, the terminal end 38 of the lower run 20 is upturned as at 60 and the extreme terminal end is rounded as at 62. The lower run, of course, is sized for passage through the hole 34 of the items. In the preferred embodiment, although various means may be provided for attaching the inner end 14 of the hook 12 so as to extend horizontally therefrom, the hook, which is rigid, may be provided with a foot assembly generally indicated by the numeral 80 which is composed of a downturned leg 82 of the upper run and is welded medially to a laterally extending member 84 with axially extending portions 86 and 88 which are sized to be received in holes or a channel in a board 90 with the ends 92 and 94 being upturned as indicated for hooked-up engagement with the board which is fastened securely to a wall.

In use the card items may simply be removed by a downwardly directed force in a quick snapping action as indicated by the arrowed line 50 after the same have been inserted as indicated by the arrowed line 57. It will be noted that the space between the upper run 18 and the lower run 20 is sufficient in relation to the distance between the margin and the hole to accommodate easy forward movement and that the terminal end 62 is spaced from this run 18 a sufficient distance to permit mounting of items on the hook.

The hook in the preferred embodiment extends outwardly, the upper run being about 6 inches in length and the distance between the upper edge of the upper run and the lower edge of the lower run being about $\frac{7}{8}$ inch. The runs which may be circular, and of about 7/32 inch diameter. The lower run, preferably, extends from the outermost end of the hook about $4\frac{1}{2}$ inches and the inner end of the lower end is upturned for a length of about $\frac{1}{2}$ inch at an angle which is preferably about 10 degrees. Also the extreme terminal end of the lower run may be rounded. The inner end of the upper run is downturned for a suitable distance of about $1\frac{3}{8}$ inches and the lateral member is about 1 inch across while the inwardly projecting legs extend upwardly so as to be spaced inwardly from the downturned upper run leg by a distance of about $\frac{5}{8}$ inches so that there is provided an overall outwardly extending hook run of about 6 inches with the upper two portions of the laterally extending member being in hooked-up engagement with the wall surface and the downturned leg being on the outside surface of the wall leg so as to provide sufficient support when the downward jerking motion 50 slices the cutting edge of the blade through the margin of the card.

What is claimed is:

1. For supporting package items having a through hole adjacent one edge, a rear loadable hook having an inner end adapted to be supported by a vertical surface, and an outer end, and said hook including an upper run extending between the ends, and a lower run connected to the upper end at the outer end and extending generally horizontally from the outer end toward but not to a terminal end adjacent the inner end, and the zone of juncture between the runs at the outer end defining a bite, said hook including a blade having a cutting edge facing said inner end and extending between the upper and lower runs for removal of the items by slicing the margin adjacent the hole, said lower run being sized for passage through the hole for movement of the items along the lower run progressively toward said blade, and said inner end including means to mount said hook to a vertical surface.

2. The device as set forth in claim 1 wherein said hook runs are of circular cross section throughout their length.

3. The device as set forth in claim 1 wherein the lower run is angularly arranged adjacent the terminal end so as to extend outwardly but not to the upper run.

4. The device as set forth in claim 1 wherein said means to mount comprises a downturned leg on said upper run at said inner end and a laterally extending member extending equidistance in perpendicular relation from the upper run and thence into parallel relation with said upper run defining a leg and an upturned foot on each of said legs for upturned connection with a vertical surface.

5. The device as set forth in claim 1 wherein said blade is welded in the bite of said hook.

* * * * *